US005877566A

United States Patent [19]

Chen

[11] Patent Number: 5,877,566

[45] Date of Patent: Mar. 2, 1999

[54] SUBMERSIBLE MAGNETIC MOTOR HAVING IMPROVED ROTARY BLADES

[76] Inventor: Chi-Der Chen, No. 1-4, Lane 147, Hsia-Men St., Taipei, Taiwan

[21] Appl. No.: 963,090

[22] Filed: Nov. 3, 1997

Related U.S. Application Data

[63] Continuation of Ser. No. 621,800, Mar. 22, 1996, abandoned.

[51] Int. Cl.[6] ..... H02K 5/132; F01D 9/02

[52] U.S. Cl. ..... 310/63; 310/86; 310/87; 310/58; 416/723 R; 416/131; 416/132 R; 416/140; 416/107

[58] Field of Search ..... 310/63; 415/87

[56] References Cited

U.S. PATENT DOCUMENTS

| | | | |
|---|---|---|---|
| 3,442,493 | 5/1969 | Smith, Jr. | 416/140 |
| 4,022,545 | 5/1977 | Shank | 416/221 |
| 4,832,573 | 5/1989 | Dorski | 416/241 |
| 5,238,367 | 8/1993 | Ellis et al. | 416/188 |

FOREIGN PATENT DOCUMENTS

| | | | |
|---|---|---|---|
| 2532442 | 2/1976 | Germany | 416/132 |
| 135273 | 8/1982 | Japan | 416/140 R |

*Primary Examiner*—Nestor Ramirez
*Assistant Examiner*—Karl Eizo I. Tamai
*Attorney, Agent, or Firm*—Ladas & Parry

[57] ABSTRACT

A submersible magnetic motor having improved rotary blades comprising a magnetic motor body, a magnetic rotor and a rotary impeller wherein the rotary impeller comprises a rotary hub provided with a plurality of blades which are uniformly distributed and extend outwardly around the periphery of the hub. The rotary hub is provided with an axial hole centrally formed therethrough for positioning an end of a central shaft of the magnetic rotor. The present invention is characterized in that the blades are each provided at the outer end edge with two stoppers and a fin freely pivoted therebetween, so as to be adjacent to the inner surface of the wall of the receiving chamber of the submersible motor. When the magnetic rotor is actuated to rotate, the fins each pivots to contact one of the two stoppers due to the resistance of the water such that the submersible motor can be maintained at a constant rotation speed, and the water pumping efficacy can be substantially improved.

7 Claims, 6 Drawing Sheets

SUBMERSIBLE MAGNETIC MOTOR HAVING IMPROVED ROTARY BLADES

This application is a continuation of application Ser. No. 08/621,800 filed on Mar. 22, 1996 now abandoned.

FIELD OF THE INVENTION

The present invention relates to a submersible magnetic motor having improved rotary blades and, in particular, to a submersible magnetic motor (i.e., a water pumping motor) having improved rotary blades capable of significantly enhancing water pumping function and efficiency.

DESCRIPTION OF PRIOR ART

In conventional submersible magnetic motors, electricity flows through coils to produce magnetic forces which results in an attractive force and a repulsion force to the magnet on the rotary shaft of the magnetic rotor such that the magnetic rotor rotates at a high speed of 3600 rpm, thereby the rotary blades pushes against on the water to achieve the water pumping effect. Such submersible magnetic motors, however, are characterized in that the magnetic rotor rotates in indefinite directions, that is, the magnetic rotor may rotate either clockwise or counterclockwise, depending on the critical direction of the magnetic flutter at the moment when it is actuated.

In view of the characteristics and restrictions of such rotation in indefinite directions, the rotary impellers of submersible magnetic motors available in the market are designed to have all flat blades (see FIG. 1). Such flat blades have the advantage that they are suitable for both clockwise and counterclockwise rotations of the submersible magnetic motor. When the impellers rotate, water flow will first strike at the surfaces of the blades at right angles, and then flow radially outwardly fast along the blade surfaces due to the flat design of the blade surfaces and finally swirl in the same direction of the high speed rotation of the rotary blades. Due to the considerable gap existing between the end edges of the blades and the inner wall of the receiving chamber, part of the water flow seeps into the said gap; however, it flows out of the range of the rotational push of the rotary blades and gradually idly stays within the gap in a free state. Therefore, the water pumping efficiency of the submersible magnetic motor is usually unsatisfactory.

If the length of the blades is slightly increased to substantially reduce the gap where the idle water flow is formed, due to the fact that the end edges of the rotary blades become too close to the inner wall of the receiving chamber, it becomes extremely difficult to overcome the excess of actuating resistance caused by the water pressure which is applied to the blade surfaces with the limited actuated magnetic force subject to the specifications of the motor. In such cases, it is impossible to actuate the magnetic rotor and the rotary blades. In reference to the technical difficulty, all of the submersible magnetic motors available in the market have had to retain an adequate gap between the end edges of the rotary blades and the inner wall of the receiving chamber such that the rotary blades can be actuated to thus get a less ideal water pumping effect.

In addition to the aforesaid submersible magnetic motor rotating in indefinite directions, those skilled in the art have attempted to employ submersible magnetic motors rotating in a definite direction (i.e., rotating in a single direction along with arcuate rotary blades (see FIG. 2) to replace conventional submersible magnetic motors and the flat rotary blades so as to overcome the disadvantage of the inefficient water pumping. The motor with a rotation having a definite direction and the arcuate blade design can decrease the actuating resistance of blades generating from water pressure by the convex sides of the arcuate blades such that the length of the blades can be slightly extended so as to reduce the gap between the end edges of the rotary blades and the surface of the inner wall of the receiving chamber, and thus can slightly improve the water pumping efficiency of the motor. The manufacturing costs of the motor with a rotation having a definite direction, however, are much higher than conventional submersible magnetic motors, and, in fact, are not competitive in the market. If the said "arcuate" rotary blades are used with the above indefinite directional rotation submersible magnetic motors, and if unfortunately the magnetic rotor actuates in the same direction as the concave sides of the arcuate rotary blades, the rotor of the submersible magnetic motor will not be able to rotate and will be of no use at all because the actuating resistance generated by water pressure on the said concave sides is much greater than that on the surfaces of the flat blades.

SUMMARY OF THE INVENTION

The primary object of the present invention is to provide improved rotary blades for use with a submersible magnetic motor, in which the gap size between the end edges of the rotary blades and the surface of the inner wall of the receiving chamber is substantially reduced so as to minimize the loss of the pumping efficiency resulting from the idle rotation of the free water flowing along the inner wall of the receiving chamber, and in which the water pressure is maintained so that an excess of actuating resistance on the rotary blades will not be caused and the submersible magnetic motor will always be rotated smoothly in either direction.

A further object of the present invention is to provide improved rotary blades for use with a submersible magnetic motor, in which the surface areas of the blades are enlarged and the gap for idle rotation of the free water is reduced and in which the submersible magnetic motor is rotated at a constant speed, so as to improve the water pumping efficiency of the submersible magnetic motor.

The structure and features of the present invention will become apparent to those skilled in the art from the following description in conjunction with the accompanying drawings.

DETAILED DESCRIPTION OF EMBODIMENTS

Figure 1:
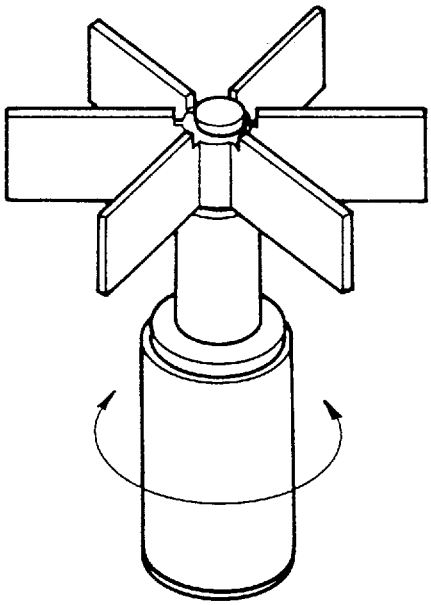
FIG. 1 (PRIOR ART)
FIG. 1 is a perspective view showing the assembly of the magnetic rotor and the rotary blades used in conventional submersible magnetic motors.
Figure 2:
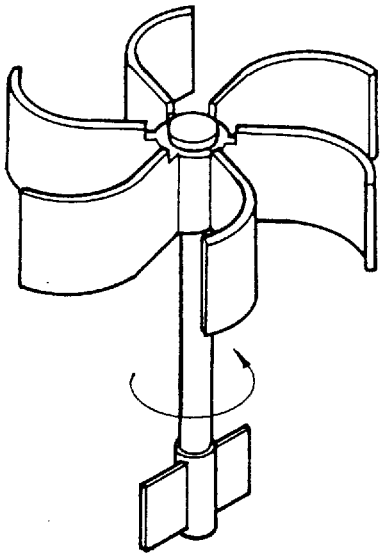
FIG. 2 (PRIOR ART)
FIG. 2 is a perspective view showing the component of the arcuate rotary blades used exclusively in the definitely directional motors.
Figure 3:
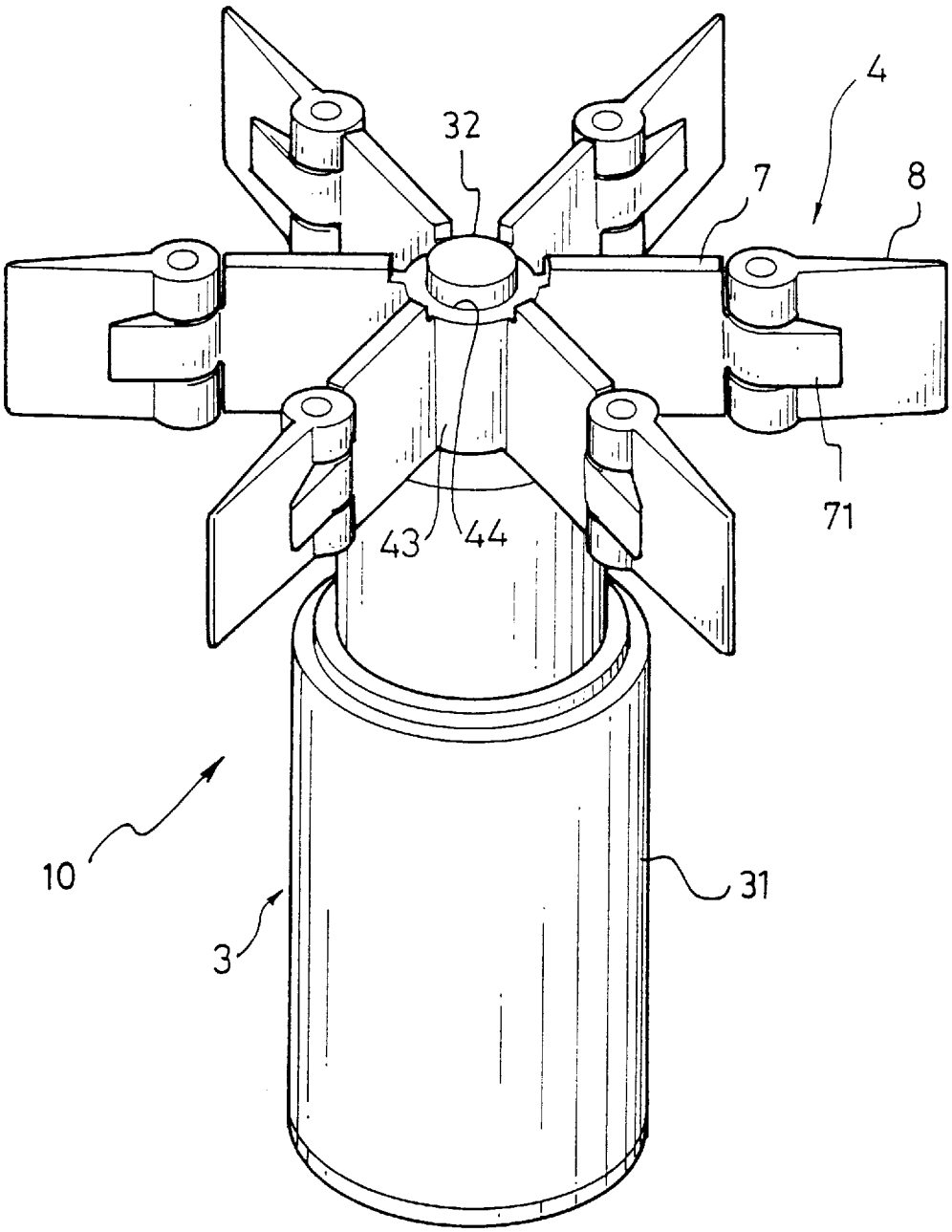
FIG. 3 is a perspective view showing the assembly of the magnetic rotor and the improved rotary blades, each provided with a pivoting fin, of the present invention.

FIG. 3 shows the improved rotary blades according to the present invention, relating to a device of magnetic rotary blades 10 which is the assembly of improved rotary blades and a magnetic rotor.

Figure 4:
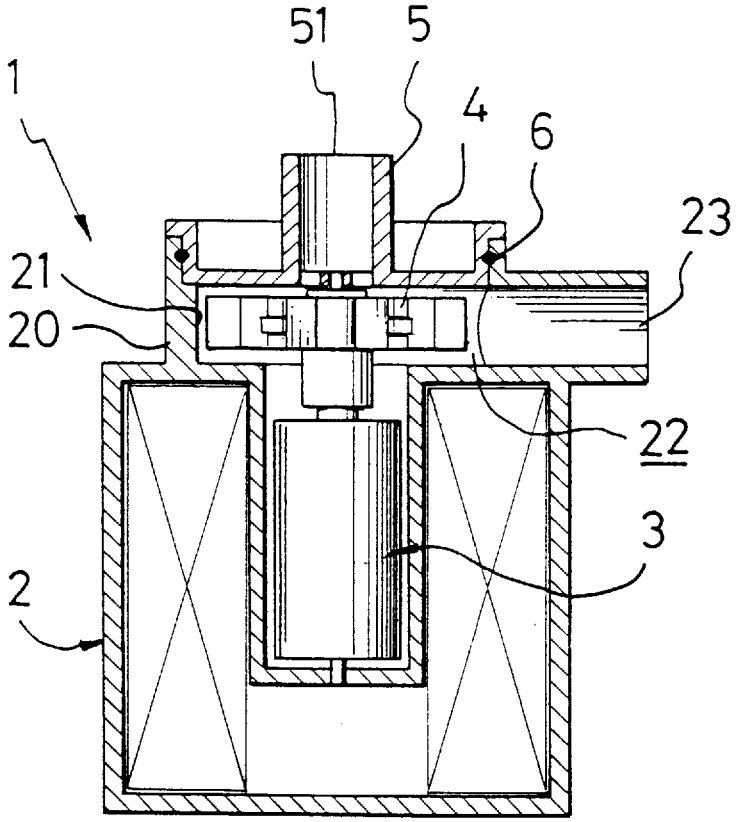
FIG. 4 is a vertical cross section view comprising the assembly of the improved rotary blades and the magnetic rotor as shown in FIG. 3 of the present invention.

As shown in FIGS. 3 and 4, the submersible magnetic motor 1 of the present invention comprises primarily a motor body 2, a magnetic rotor 3, a rotary impeller 4, and a sealing cap 5 of receiving chamber.

The motor body 2 is provided with a motor housing 20 with one side thereof extending outwardly to form a generally annular wall of receiving chamber 21. The sealing cap 5 is provided with at least a water inlet 51 at the central portion thereof and is adapted to close over the outer end side of the wall of receiving chamber 21 so as to define a receiving chamber 22, and the wall of receiving chamber 21 is provided with an outwardly extending water outlet 23 on the top of the receiving chamber 22.

The magnetic rotor 3 has a central shaft 32, which is provided with a cylindrical rotor magnet 31 disposed at a portion thereof. The rotary impeller 4 has a hub 43, which is provided with an axial hole 44 centrally formed therethrough. The rotary impeller 4 is provided with a plurality of blades 7 which are uniformly distributed and radially outwardly extended around the periphery of the hub 43. The rotary impeller 4 is secured by positioning an end of the central shaft 32 opposite the rotor magnet 31 through the axial hole 44.

When the magnetic rotor 3 is mounted and positioned inside the motor body 2, the rotary impeller 4 positioned at an end of the central shaft 32 of the magnetic rotor 3 is exactly positioned inside the receiving chamber 22.

The difference between the subject invention as shown in FIG. 3 and the prior art mainly resides in the design for the rotary impeller 4.

Figure 7:
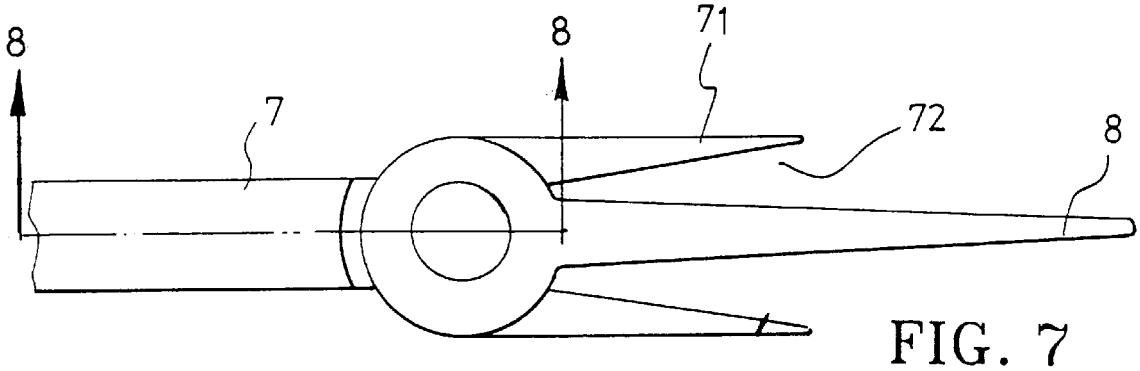
FIG. 7 is an enlarged detailed top plan view showing the end of the improved rotary blade of FIG. 3.
Figure 8:
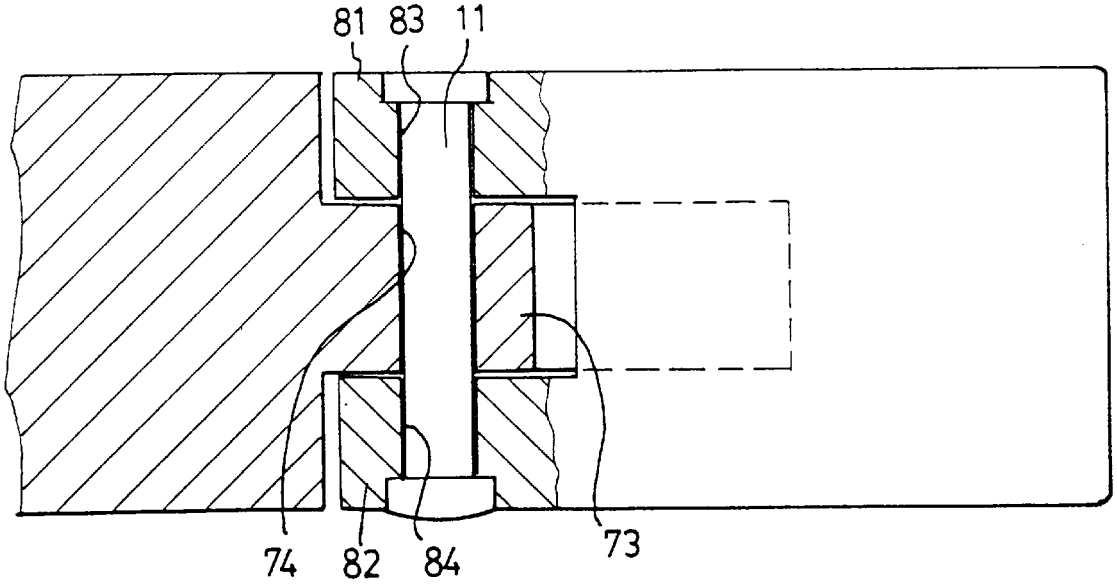
FIG. 8 is a cross section view along line 8—8 of FIG. 7.
Figure 9:
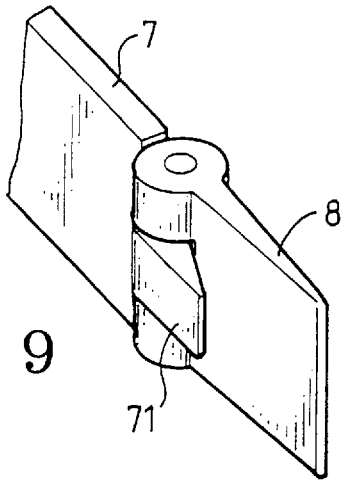
FIG. 9 is an enlarged detailed perspective view showing the end of the improved rotary blade of FIG. 3.
Figure 10:
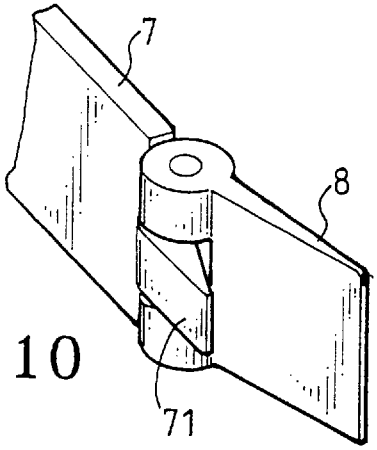
FIG. 10 is an enlarged detailed perspective view showing the end of the improved rotary blade of FIG. 3 during clockwise rotation.
Figure 11:
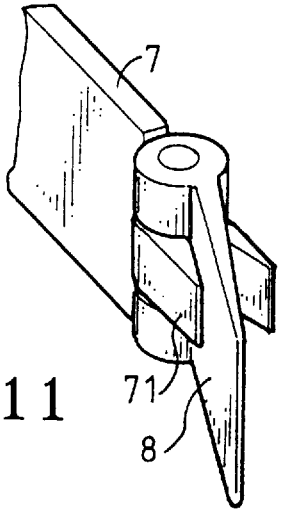
FIG. 11 is an enlarged detailed perspective view showing the end of the improved rotary blade of FIG. 3 during counterclockwise rotation.

As shown in FIGS. 7 and 8, the improved rotary blades are characterized in that each of the blades 7 is provided with two stoppers 71 extending out at an end edge thereof so as to provide a pivoting space 72 therebetween and includes a fin 8 pivoted at the end edge thereof, and the fin 8 freely pivots on an axis parallel to the central shaft 32. The blades 7, the stoppers 71 and the fins 8 are formed of suitable plastic material such as polypropylene (pp) or the like so as to maintain their desired flexibility when being subjected to water resistance.

The stoppers 71 can be disposed in any suitable approaches. Preferably, each of the blades 7 is provided with a joint 73 at a central region of the end edge thereof, the joint 73 is provided with a vertical pin hole 74 formed therethrough, and the two stoppers 71 extend out from the joint 73. Each of the blades 7, the joints 73 and each of the two stoppers are preferably formed integrally. The device of magnetic rotary blades 10 according to the subject invention further comprises a pin 11 for each blade 7. The fin 8 is provided with two joints 81, 82 at an upper end edge and a lower end edge thereof respectively. The two joints 81, 82 have a shape similar to each other and are adapted to engage with the joint 73 at the end edge of the blade 7. The two joints 81, 82 of the fin 8 are respectively provided with pin holes 83, 84 centrally formed therethrough and corresponding to the pin hole 74 of the blade 7 such that after the two joints 81, 82 of the fin 8 ride astride on the joint 73 of the blade 7, the pin 11 serving as a pivot can go through all of the pin holes 83, 74 and 84 for positioning, thereby the fin 8 can freely be pivoted in the space 72 between the two stoppers 71.

Figure 5:
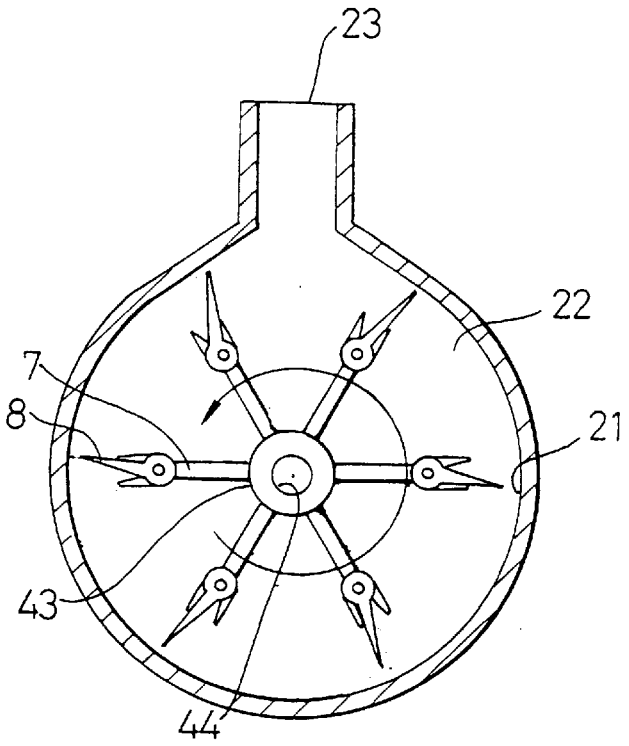
FIG.5 is a schematic plan view showing the improved rotary blades of FIG. 3 arranged in the receiving chamber for counterclockwise rotation.
Figure 6:
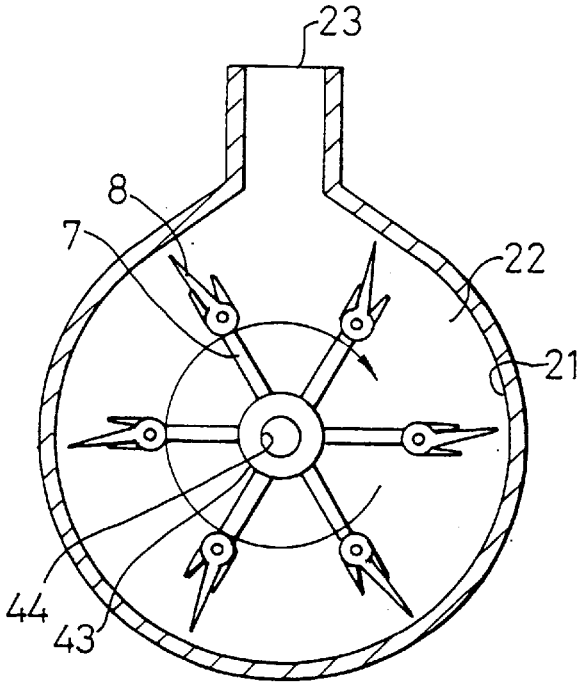
FIG. 6 is a schematic plan view showing the improved rotary blades of FIG. 3 arranged in the receiving chamber for clockwise rotation.

As shown in FIGS. 5 and 6, when the magnetic rotor 3 of the submersible magnetic motor 1 is actuated to rotate, since the blades 7 are shorter than the conventional ones and the extended portions, that is, the fins 8 pivoted with the blades 7, are pivotable such that the fins 8 are swayed in the direction along the water resistance, the hydraulic actuating resistance to which all the blades 7 and the pivotable fins 8 are subjected is thus significantly less than that to which the conventional blades are subjected. As a result, there will be no difficulty at all for the magnetic rotor 3 to be actuated to rotate. And, when the magnetic rotor 3 is actuated, the fins 8 pivot in a direction opposite the direction of rotation of the blades 7 to relieve the hydraulic resistance and and to minimize the loss of the water pumping due to the reduction of the free water along the inner surface of the wall of receiving chamber 21 such that the water pumping capacity is substantially improved.

The two stoppers 71 and the fins 8 can be configured to any proper shape. Preferably, each of the stoppers 71 and the fins 8 gradually decreases in thickness in an outward direction apart from its corresponding blade 7, and the fin 8 exactly closely attaches the inner surface of one of the two stoppers 71 when the magnetic rotor 3 is rotated and the fin 8 is pivoted under water resistance. Moreover, optimal water pumping effect can be achieved if the two stoppers 71 defining the pivoting space 72 are at an angle of 60 degrees to each other.

While the present invention has been described in connection with preferred embodiments, various changes and modifications can be made by those skilled in the art without departing from the technical principle of the present invention. For example, a sealing 6 or the like can be further disposed between the wall of receiving chamber 21 and the sealing cap 5. Such changes and modifications are; however, intended to be covered within the scope as defined in the appended Claims.

BRIEF DESCRIPTION OF REFERENCE NUMERALS

| | |
|---|---|
| 1 submersible magnetic motor | 2 motor body |
| 3 magnetic rotor | 4 rotary impeller |
| 5 sealing cap | 6 sealing |
| 7 blades | 8 fin |
| 10 device of magnetic rotary blade | 11 pin |
| 20 motor housing | 21 wall of receiving chamber |
| 22 receiving chamber | 23 water outlet |
| 31 rotor magnet | 32 central shaft |
| 43 hub | 44 axial hole |
| 51 water inlet | 73 joint of blade |
| 74 pin hole in joint | 81 upper joint of fin |
| 82 lower joint of fin | 83 pin hole in upper joint |
| 84 pin hole in lower joint | |

I claim:

1. A motor comprising a magnetic rotor and a rotary impeller, wherein:

the magnetic rotor has a central shaft and a rotor magnet disposed at a portion of the shaft; and the rotary impeller comprises a hub which is provided with an axial hole centrally formed therethrough, and a plurality of blades which are uniformly distributed around the hub and extend radially outwardly of the periphery of the hub, the blades of the rotary impeller being disposed in a pumping chamber having a wall surrounding said blades to form a radial gap therewith, said impeller being secured in position by the central shaft of the rotor which extends through said axial hole and has an end opposite the rotor magnet;

each of the blades including a fin pivoted to an end edge of the respective blade for movement about an axis parallel to the central shaft; each of the blades further including two stoppers extending outwardly at the end edge of the blade to provide a space therebetween for limited, pivotal movement of the fin;

said impeller being rotatable by said rotor in opposite directions of rotation and when the rotary impeller rotates in said pumping chamber filled with fluid, the fins on the blades are subjected to fluid resistance and pivot in a direction opposite the rotation of the impeller, to contact respective ones of the stoppers whereby the blades of the impeller are effective to pump the fluid in either direction of rotation of the rotor;

each said blade including a joint at a central region of said end edge thereof, said joint having a vertical pin hole extending therethrough, said two stoppers extending outwardly at said joint to face only a central portion of said fin, said fin including two joints engaged with said joint at the end edge of the blade, said two joints being disposed astride said joint at the end edge of the blade and being provided with respective vertical pin holes therethrough aligned vertically with the pin hole in the joint of said blade, and a pin extending through the pin holes of all of said joints so that the fins are each freely pivotable individually between the two stoppers and is limited by engagement of said stoppers with said central region of the associated fin.

2. The motor according to claim 1 wherein the blades, the stoppers and the fins are formed of polypropylene.

3. The motor according to claim 1 wherein the blades, the joints and the stoppers are formed integrally.

4. The motor according to claim 1 wherein each of the stoppers and the fins gradually decreases in thickness in a radially outward direction from its corresponding blade, said stoppers having end edges for contacting said fin, said end edges of said stoppers having a vertical height substantially equal to a vertical height of said joint of said blade.

5. The motor according to claim 4, wherein said two stoppers form an angle of 60 degrees therebetween.

6. A motor according to claim 1, wherein said impeller is coaxially mounted in said pumping chamber and said fins pivot, in said pumping chamber, about their respective axes parallel to the axis of the central shaft of the rotor.

7. The motor according to claim 1, wherein said stoppers extend integrally outwards from said blade at the end edge of the blade.

* * * * *